US005138915A

United States Patent [19]

Doll

[11] Patent Number: 5,138,915

[45] Date of Patent: Aug. 18, 1992

[54] IMPACT PIPE WRENCH

[76] Inventor: Don Doll, 4739 S. 1900 East, Ogden, Utah 84403

[21] Appl. No.: 706,268

[22] Filed: May 28, 1991

[51] Int. Cl.[5] ..... B25B 19/00

[52] U.S. Cl. ..... 81/463; 81/57.33; 81/464

[58] Field of Search ..... 81/57.33, 463, 464

[56] References Cited

U.S. PATENT DOCUMENTS 4,307,635 12/1981 Genova .
4,436,002 3/1984 Kennington et al. .
4,771,661 9/1988 Levchenko et al. .

*Primary Examiner*—James G. Smith
*Attorney, Agent, or Firm*—Trask, Britt & Rossa

[57] ABSTRACT

A wrench has a handle with a jaw for gripping a workpiece. The jaw is formed of a first jaw member which moves transversely with respect to the handle and a second jaw member which is connected to the handle by an adjustment nut and extension to move relative to the first jaw member. An air motor delivers impact forces to a hammer which in turn transfers the impact forces to the first jaw member. The air motor is controlled by a valve secured to the handle. The surfaces of the jaw members may be exchanged to interface with specific workpieces.

24 Claims, 6 Drawing Sheets

IMPACT PIPE WRENCH

BACKGROUND OF THE INVENTION

1. Field

This application relates to tools, wrenches and more specifically to a wrench and a pipe wrench for applying an impacting torque to a workpiece.

2. State of the Art

A pipe wrench with gripping jaws to hold a pipe and a movable vibrating jaw is disclosed in U.S. Pat. No. 4,771,661 (Levchenko). Levchenko has a vibrator in a hollow handle positioned to compress a spring positioned to vibrate a movable jaw. When a workpiece is positioned in the jaws of the wrench, the vibrator and spring cause the movable jaw to vibrate at an electrical frequency.

A slide hammer adapter to convert a locking jaw plier to an impacting device is disclosed in U.S. Pat. No. 4,307,635 (Genova). The slide hammer adapter is designed to replace the standard thumb adjustment screw found in nearly all locking jaw type pliers.

A pipe gripping tong with movable jaws to grip different sizes of pipe is disclosed in U.S. Pat. No. 4,436,002 (Kennington). The movable jaws are elliptically shaped and driven into contact with a pipe by a ring gear. A motor and gear assembly can subsequently apply a torque to the pipe but the device does not have impacting capabilities.

Mechanical fittings such as nuts and bolts and pipe joints can become locked or frozen in place for a variety of reasons, including corrosion of the threads of a pipe joint or nut and bolt. The threads of the pipe joint or nut and bolt may also be distorted or frozen due to temperature extremes, debris in the fitting, or hardening of old sealants or lubricants applied during assembly. In such circumstances, disengagement of the mechanical fittings may be difficult.

When a wrench such as a pipe wrench cannot be operated to deliver sufficient torque to disengage a nut from a bolt or rotate a pipe from a pipe joint or union, workers are understood to sometimes fit an extension over the handle of a conventional pipe wrench to give the user more leverage. The increased lever arm enables the worker to apply more torque to the frozen joint in an attempt to break free the frozen joint. In some cases, however, a pipe may twist and break under the increased torque before the frozen joint disengages. In other cases, a bolt may snap or a nut may be damaged. Various lubricants and penetrating oils can also be applied to the joint to facilitate freeing the frozen joint, but time delays may be involved, and in some cases, such fluids may be ineffective.

There is a need for a wrench capable of effectively applying an impact torque to the exterior of mechanical fittings such as pipe to facilitate relative movement between the parts of a fitting (e.g., nut and bolt) or pipe joint.

SUMMARY OF THE INVENTION

A wrench includes handle means and jaw means adapted thereto for gripping a workpiece. The jaw means includes a first jaw member movably secured to the handle means to move relative to the handle means about a workpiece. A second jaw member is positioned to move toward and away from the first jaw member to secure the workpiece thereinbetween. Connection means are provided to connect the second jaw member to the handle means. Connection means also may be operated by the user to move the second jaw member relative to the first jaw member. Movement means are also provided and adapted to the handle means. They are positioned to urge the first jaw member to move in a first direction about the workpiece.

In a preferred arrangement, the movement means includes return means connected to the handle means and positioned to contact the first jaw member to urge the first jaw member in a second direction opposite to the first direction. The movement means may also include a striking member connected to an outside source of energy positioned proximate the first jaw member to intermittently impact the first jaw member to urge the first jaw member in the first direction.

The workpiece has an axis; and the first jaw member is positioned to urge the workpiece to rotate about the axis of the workpiece. The striking member preferably includes a hammer member positioned to urge the first jaw member to move and a motor member positioned to intermittently drive the hammer member.

The first jaw member desirably has a first workpiece engaging surface for contact with the workpiece. The second jaw member similarly has a second workpiece engaging surface for contact with the workpiece. Desirably the first workpiece engaging surface is formed to have a friction means for frictionally engaging the workpiece. Similarly, the second workpiece engaging surface is essentially planar and formed to have a friction means for frictionally engaging a workpiece. Alternately, the workpiece engaging surface may be shaped to accommodate a selected workpiece and may be removable.

The handle means has a handle axis and the first jaw member is positioned to move substantially transverse to the handle axis. In a desired arrangement, the hammer member is secured to the handle means to rotate or pivot about a hammer axis which is also substantially transverse to the handle axis. The hammer member preferably has a first surface positioned to be contacted by the motor member to urge the hammer member to rotate about the hammer axis. Upon rotation about the hammer axis, the hammer member urges the first jaw member in the first direction.

The motor means preferably has an impact member extending therefrom to contact the first surface of the hammer member. The motor means is positioned relative to the handle means to extend in a direction generally in alignment with the handle axis. The motor means may be an air motor or a solenoid.

In another arrangement, the striking member provided includes a motor positioned on the handle. The motor has a rotatable shaft extending therefrom with a cam secured to the shaft. The cam is positioned relative to the first jaw member to intermittently urge the first jaw member in the first direction upon rotation of the rotatable shaft.

In a preferred configuration, the handle means includes a grip for grasping by the user to rotate the wrench and in turn the workpiece.

In an alternate configuration, the connection means includes an adjustment member having a jaw end to which the second jaw member is connected. The connection means also has a threaded end which threadedly engages a rotatable member secured to the handle means. Upon operation of the rotatable member, the second jaw member is urged toward and away from the first jaw member to facilitate secure positioning about the workpiece. The adjustment member also has an axis which is in general alignment with the handle axis.

A spanner member is positioned to contact the first jaw member to urge movement thereof upon contact by the hammer member. The spanner member is formed to move about the adjustment member.

In a highly preferred arrangement, a pipe wrench is provided for rotating a workpiece about its axis. The pipe wrench includes a handle, a first jaw member, a second jaw member and a spanner member. It also includes a motor secured to the handle operable by external energy to move a shaft towards and away from the motor to strike a hammer which has a first surface positioned to be contacted by the shaft. The second surface of the hammer is positioned to contact the spanner member to urge the spanner member to contact the first jaw member and urge the first jaw member in a first direction. A return spring is positioned to urge the first jaw member in a second direction opposite to the first direction. Means are also provided to activate and deactivate the motor.

BRIEF DESCRIPTION OF THE DRAWINGS

In the drawings which illustrate what is presently regarded as the best modes for carrying out the invention.

DETAILED DESCRIPTION OF THE ILLUSTRATED EMBODIMENT

Figure 1:
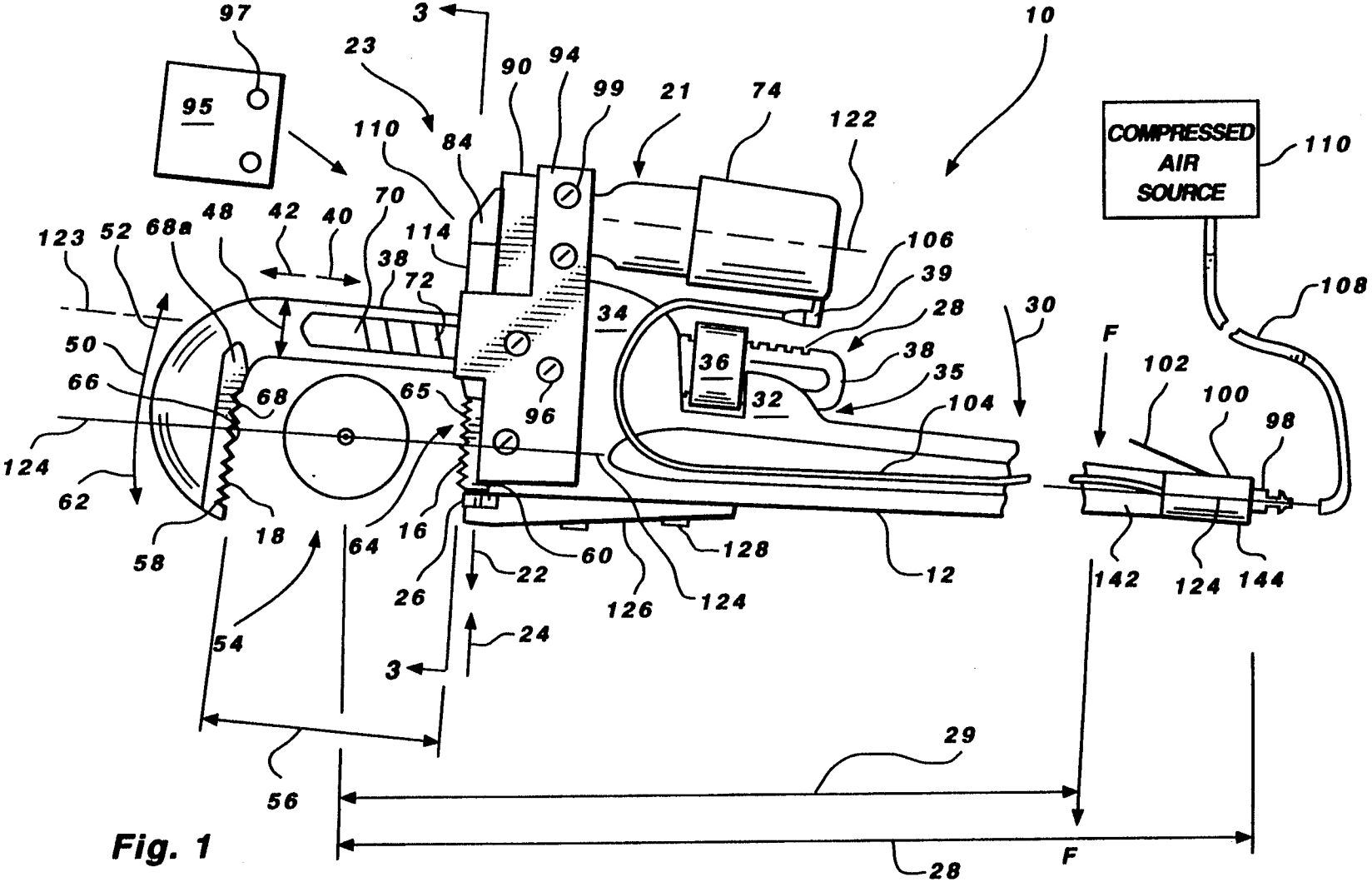
FIG. 1 is a perspective side view of a wrench of the instant invention.

FIG. 1 depicts a wrench 10 configured to function as a pipe wrench. It has handle means which is here depicted in broken section to be an elongated handle 12. The wrench 10 also has jaw means for gripping a workpiece 14. The jaw means includes a first jaw member 16 which is secured to the handle 12 and is movable relative to the handle 12 about the workpiece 14 as more fully discussed hereinafter. The jaw means also includes a second jaw member 18 which is positioned to move toward and away from the first jaw member 16 to secure the workpiece 14 thereinbetween. The second jaw member 18 is secured to the handle 12 by connection means 20 which are more fully discussed hereinafter. The wrench 10 also includes movement means which is secured to the handle 12 and positioned to urge the first jaw member 16 in a first direction 22 about the workpiece 14.

The movement means includes a motor means 21 operable by energy from an external source to generate periodic impact forces and a striking assembly 23 positioned to transfer the impact forces from the motor means to the first jaw member 16. The movement means also includes return means which are connected to the handle means and positioned to contact the first jaw member 16 to urge the first jaw member 16 in a second direction 24 opposite to the first direction 22. The return means is a resilient, elastically deformable member 26 which is positioned to urge the first jaw member 16 in the second direction 24. As herein shown, the return means is a durable piece of rubber appropriately sized to elastically compress. A metal spring may also be used.

As shown in FIG. 1, the wrench 10 has a handle 12 which is selected to have a length 28 as desired to provide appropriate leverage. That is, the length 28 of the handle 12 is selected so that a user may apply force F in the direction 30 in order to rotate the wrench 10 and in turn the workpiece 14. The distance 29 at which the force F is applied produces a predesired torque (in foot pounds) in order to urge the workpiece 14 in the desired direction. The handle 12 is shown in broken section and not full-length for convenience of illustration. The handle 12 is desirably made of a very durable material such as steel or a similarly acceptable strong and rigid material.

The handle 12 is formed to have a low shoulder 32 and a high shoulder 34 spaced apart as shown in order to receive thereinbetween an adjustment member which is an adjustment nut 36. The adjustment nut 36 is internally threaded to receive the threads 39 formed in extension 38. The extension 38 extends through an appropriately sized aperture 44 (FIG. 6) formed in the large shoulder 34 to the second jaw member 18. A slot 35 is also formed in the small shoulder 32 so that the extension 38 may move herein relative to the handle 12. In turn, the second jaw member 18 may move toward 40 and away 42 from the first jaw member 16. Thus, the shoulders 32 and 34, along with the aperture 44, nut 36, and extension 38 with threads 39, function as connection means in order to connect the second jaw member 18 to the handle 12 and also to move the second jaw member 18 relative to the first jaw member 16.

Figure 3:
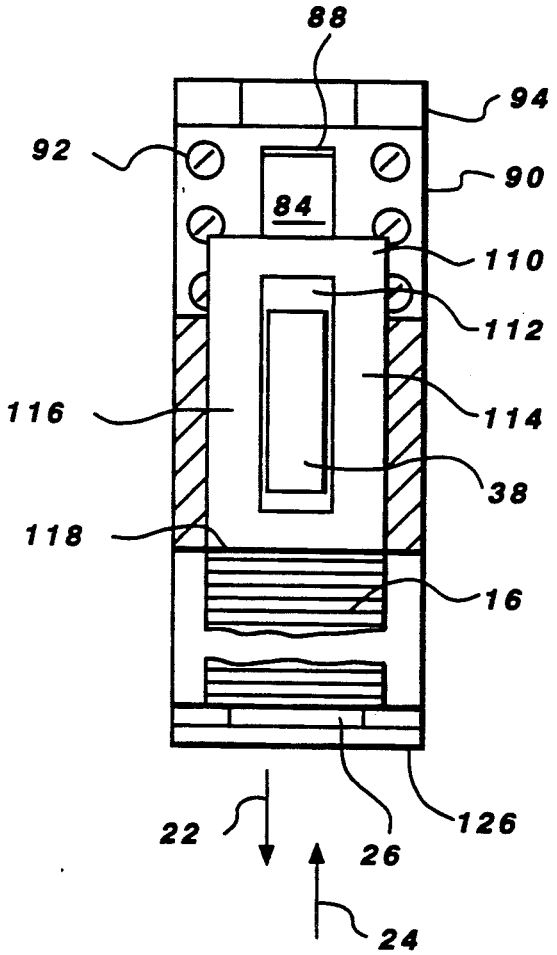
FIG. 3 partial cross-sectional front view of the wrench of the instant invention of FIG. 1 along section line 3—3.
Figure 6:
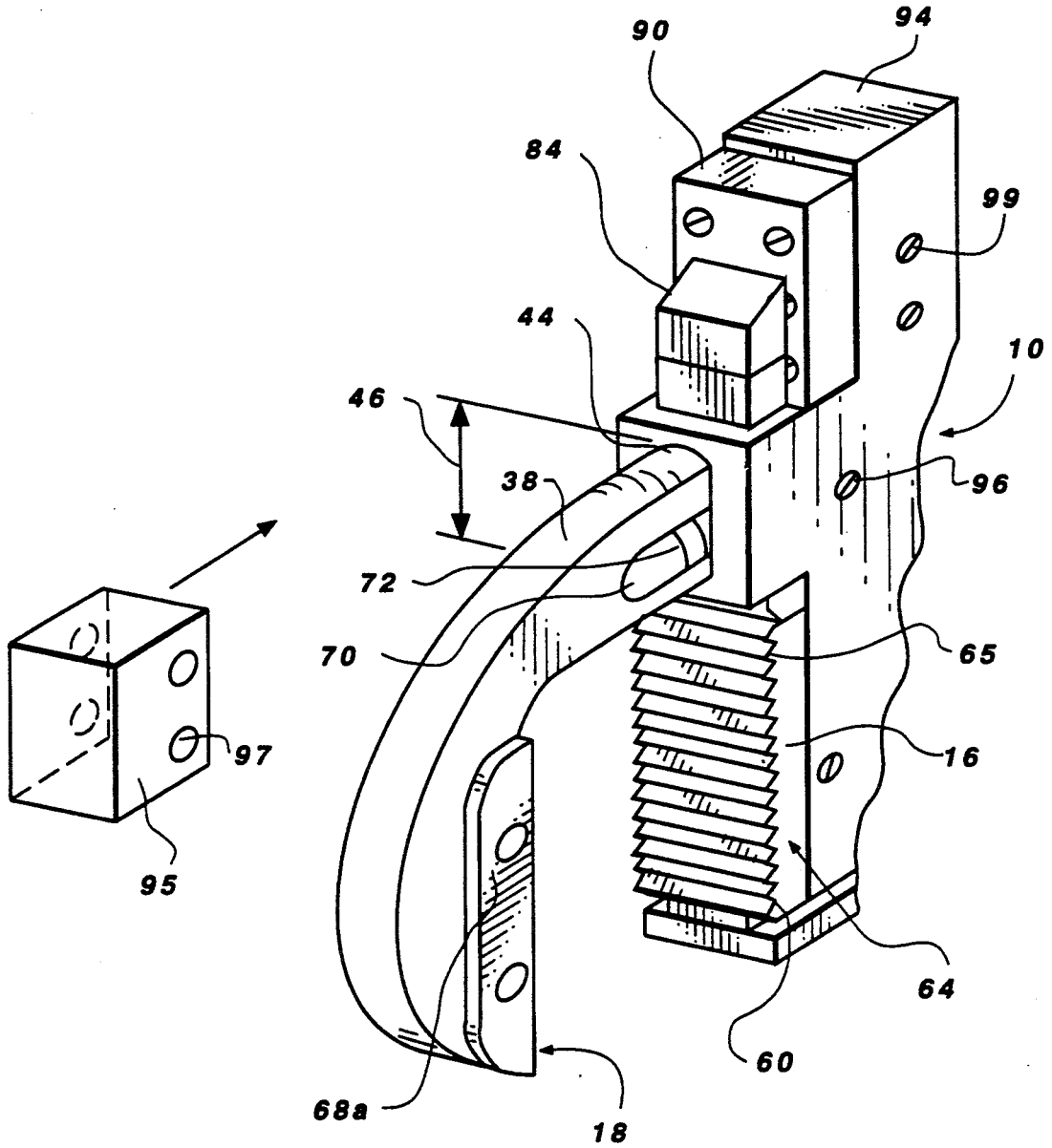
FIG. 6 is a partial perspective view of the wrench of FIG. 1.

As better seen in FIGS. 3 and 6, the extension member 38 moves through an aperture 44 formed in the large shoulder 34 of the handle 12. The aperture 44 is sized to slidably and loosely receive the extension 38. That is, the aperture 44 is formed to have a height 46 larger than the height 48 (FIG. 1) of the extension member 38. Therefore, the extension member 38, and in turn the second jaw member 38, may move about an axis not here illustrated but generally located within the interior of the shoulder 34. In turn, the second jaw member 18 may move in or along the arc 50. The movement of the extension 38 in the upward direction 52 in effect opens the mouth 54 of the jaw means. That is, the distance 56 between the lower end 58 of the second jaw member 18 and the lower end 60 of the first jaw member 16 is increased to facilitate gripping the workpiece 14. A force, such as force F, is applied to the handle 12 in the direction 30. The distance 56 is thereby closed because the extension 38 is moved relative to the handle 12 in a downward direction 62.

The first jaw member 16 has friction means which is here shown to be a saw-toothed surface 64 which forms in effect a generally planar surface. The individual teeth 65 of the saw-tooth surface 64 engage the surface of the workpiece 14. The second jaw member 18 also has friction means which is here shown to be a generally planar surface 66 having a plurality of teeth 68 formed therein for similarly gripping the surface of the workpiece 14. Even though transverse teeth 65 and 68 are here shown for both the first jaw member 16 and the second jaw member 18, other types of friction surfaces 64 and 66 may readily be used. The surfaces 64 and 66 are formed of a very hard material so the teeth such as teeth 65 and 66 will non-deformably engage the workpiece 14. Although here shown to be planar, the surfaces 64 and 66 may be arcuate or otherwise configured to interface with workpieces of a selected shape or configuration.

Notably, the second jaw member 18 may have a reinforced portion 68a shown in FIG. 1 and FIG. 6 in order to provide additional strength to the jaw member for gripping the workpiece 14. It may also be noted that the extension 38 may have a hollow portion or relief portion 70 to provide additional strength while at the same time reducing the overall weight of the wrench 10. Scribes 72 may be formed in the relief portion 70 in order to provide a visual indication of the wrench opening 56.

In reference again to FIG. 1, the wrench 10 as hereinbefore stated includes movement means which is adapted to the handle 12 and positioned to urge the first jaw member 16 in first direction 22. The movement means is here shown to include an air impact motor 74.

Figure 2:
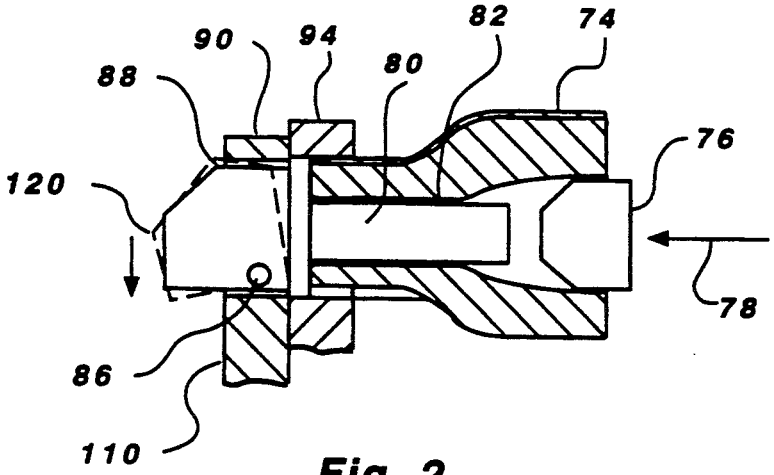
FIG. 2 is a partial cross-sectional view of a portion of the wrench of the instant invention of FIG. 1.

Referring specifically to FIG. 2, the motor 74 includes a chamber for receiving air to urge a piston 76 rapidly in an axial direction 78 to impact upon a strike pin 80. The strike pin 80 is slidably and snugly positioned within an aperture 82 to proceed in the axial direction 78 to strike striking assembly 23. The striking assembly includes hammer member 84 which is pivotally secured to rotate about the axle 86. The hammer member 84 is positioned within an aperture 88 formed in a block member 90 which is fastened by a plurality of screws 92 (FIG. 3) to motor mount 94. The motor mount 94 is secured to the large shoulder 34 by a plurality of screws 96. The hammer member 84, block member 90 and the motor mount 94 are covered with a safety cap 95 which is shown exploded away from the wrench 10 in FIGS. 1 and 6. The cap 95 is held by screws positioned through apertures 97 formed therein to register with apertures 99 formed in the motor mount 94.

The air motor 74 is a conventional air motor powered by compressed air which is supplied from an external source 110 via a supply line 108 not shown which is connected to a fitting 98. Compressed air passes through a conventional operation valve 100 which has an operating lever 102. The air is ported via an appropriate supply tube 104 to connectors 106. The connectors 106 in turn supply the air to motor 74 which operates in a conventional fashion to urge the piston 76 in an axial 122 direction.

As hereinbefore stated, the movement means includes a striking assembly 23 which includes the hammer member 84 together with a spanner member 110. The spanner member 110 moves in response to the movement of the hammer member 84. That is, the spanner member 110 has an aperture formed therein 112 in turn presenting a first leg 114 and a second leg 116 to span the extension member 38 as best illustrated in FIG. 3. The spanner member 110 transmits the impact force applied by the hammer member 84 directly to the upper surface 118 of the first jaw member 16. Thus, the impact of the strike pin 80 is transmitted to the hammer 84 which in turn transmits the impact to the spanner member 110. The impact in turn is transmitted from the spanner member 110 directly to the first jaw member 16 to urge the first jaw member 16 downwardly in a first direction 22. The return member 26 compresses and in turn urges the first jaw member 16 and in turn the spanner member 110 in the second direction opposite to the first direction upon release of the impact force delivered by the strike pin 80.

The return means may be made of a highly durable rubber which inelastically deforms upon compression and in turn urges the first jaw member 16 and in turn the spanner 110 in an upward direction 24. In turn, the hammer 84 is returned to a stored position which is shown solid in FIG. 2 from the operated or striking position as shown in phantom 120 in FIG. 2. Other types of return means may be used. A metal bar spring or even a coil spring are certainly suitable alternatives although presently believed to be more costly.

As may be noted in FIG. 1, the motor 74 is positioned along an axis 122 which is in general alignment with the axis 124 of the handle 12. Although shown in axial alignment, the extension 38 may be reconfigured so that other alignments may be used if desired. The alignment of its axis 123 with the handle axis 124 as illustrated in FIG. 1 has been preferable in that it provides for a more compact wrench which is in turn easier to store and easier to use, particularly in constricted locations.

Notably, the return means which is the rubber spring 26 is held in position by a clamp 126. The clamp 126 is held to the handle 12 by a plurality of screws 128 or similar acceptable fasteners. Indeed, the clamp 126 may also be integrally formed with the handle 12.

Figure 4:
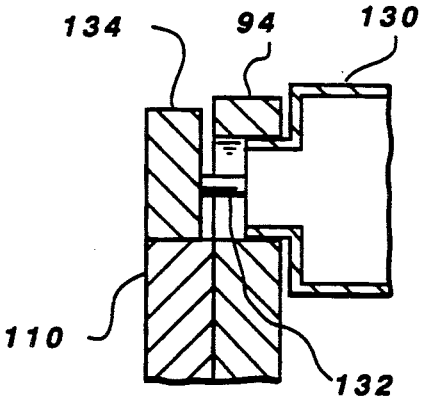
FIG. 4 is an alternate embodiment of a portion of a wrench of FIG. 1.
Figure 5:
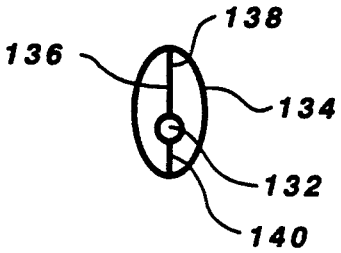
FIG. 5 is a cam for use with the embodiment of FIG. 4 of the instant invention.

In reference to the motor 74, it may be noted that alternate devices may be used or found suitable. Electrical solenoids may be used to provide the necessary striking force to cause a strike pin, such as strike pin 80, to in turn strike a hammer similar to hammer member 84. In FIGS. 4 and 5, an electric motor 130 is shown in partial cross section mounted to the motor mount 94. The electric motor drives a shaft 132 which in turn rotates a cam 134. The cam 134 in turn is in contact with the spanner member 110. As illustrated in FIG. 5, the cam 134 has a major axis 136 having a long radius 138 and a short radius 140. With the short radius 140 oriented as shown in FIG. 4, the first jaw member 16 is in its upward 24 position. Upon rotation of the motor 130 so that the large radius 138 is oriented in the downward direction 22, the first jaw member 16 is thereby urged in the downward direction 2 to in turn compress the return member 26. As the cam 134 continues to rotate, the return member 26 in turn urges the first jaw member and in turn the spanner 110 in an upward 24 direction. It may be noted that the motor 130 is threadedly secured into the motor mount 94. Similarly, the motor 74 shown in FIG. 2 is also threadedly secured into the motor mount 94.

In reference to the handle 12 of FIG. 1, it may also be noted that the handle 12 has a grip portion 142 formed proximate the distal end 144 of handle 12. As here shown, the grip portion 142 is a series of metal protrusions smoothly positioned to present a high friction surface for a user with, for example, oily or wet hands.

In operation, the user connects the wrench 10 to a source of compressed air 110 by positioning supply line 108 over the connector 98. The wrench 10 is thereafter positioned about a workpiece 14. The adjustment nut 36 is operated to cause the second jaw surface 18 to be urged toward 40 the first jaw member 16 to grip the workpiece 14 snugly thereinbetween. The user then applies a force F while simultaneously operating the lever 102 to in turn operate the valve 100. Air is thereby ported through line 104 to the air motor 74. The motor 74 thereby causes the piston 76 to rapidly and intermittently strike the strike pin 80. The strike pin 80 in turn strikes the hammer member 84 causing it to rotate to its operated position 120 shown in FIG. 2. The hammer member 84 in turn causes the spanner member 110 to move downwardly 22 in turn causing the first jaw member 16 to similarly move downwardly.

After the hammer member 84 has completed its travel to the dotted line position 120, the return member 126 (which has thereby been compressed) urges the first jaw member 16 and in turn the spanner member 110 in an upward direction 24. The hammer 84 member is thereby returned to its solid line position shown in FIG. 2. The strike pin 80 similarly is urged into its initial position similar to that shown in FIG. 2. The air motor 74 operates to pulse the piston 76 at a rate from about 3 strokes per second to about 15 strokes per second. The valve 100 may be controlled by lever 102 to regulate the rate; from zero to the maximum of the motor selected for the wrench 10. If the motor is electric, the valve 100 is an electrical variable resistance to regulate the electrical energy delivered to the motor.

In use, the user is therefore able to apply intermittent impact forces to the workpiece in order to operate or turn the workpiece 14 about its axis 15. The impact assists the user by providing additional forces above the force F applied by the user. The additional forces can be quite high but are believed to nonetheless avoid inelastic deformation of the workpiece 14 by limiting the total integrated torque applied over time. That is, the continuous forces applied are of such a magnitude that the workpiece will not bend, deform or otherwise be damaged. Impact is provided to overcome the increased resistance from corroded or excessively tight unions between two surfaces. For example, the two pipes could be readily joined by a male/female threaded relationship. In order to rotate one relative to the other in order to disassociate or disconnect them, the wrench 10 of the instant invention may be placed around one of the two pipes and operated in order to cause relative movement between them. The wrench 10 may also be used to secure one item to another. The wrench 10 may further assist in loosening or tightening nuts with respect to bolts.

Figure 7:
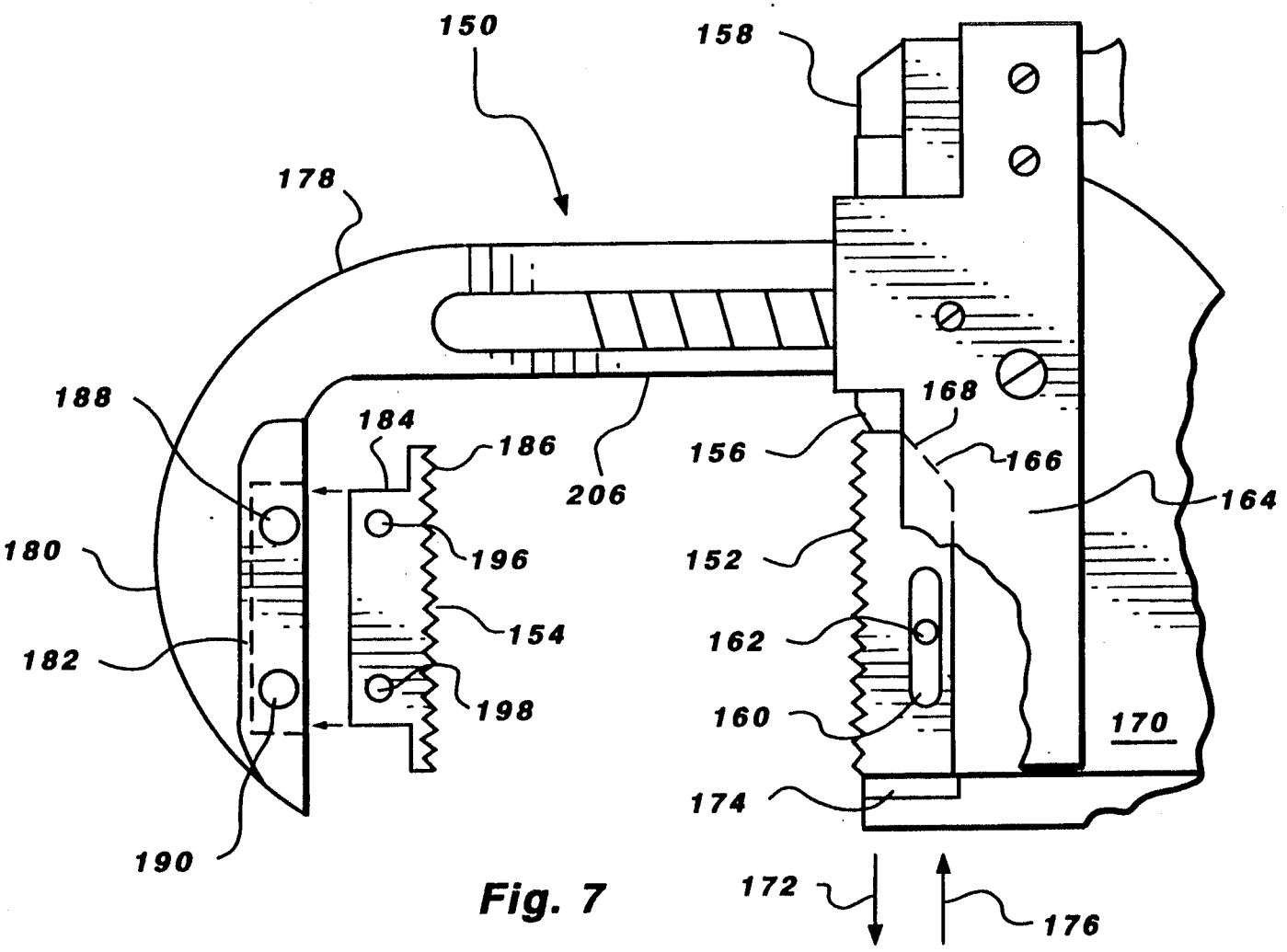
FIG. 7 is a partial cutaway view of an alternate embodiment of the wrench of the instant invention.

FIG. 7 shows a wrench 150 which is similar to the wrench 10 of FIG. 1 but configured differently. More specifically, the wrench 150 is shown only in part and with a cutaway portion to better illustrate the first jaw member 152 which is positioned opposite a second jaw member 154. First jaw member 152 is positioned to be contacted by a spanner member 156 which is similar to the spanner member 114 of FIGS. 3 and 1. In a similar fashion, the spanner member 156 is contacted by the hammer member 158 similar to hammer member 84 of FIGS. 1 and 3. Operation of the hammer member 158 and in turn the spanner member 156 is comparable to that in the embodiment illustrated and discussed in FIG. 1.

As shown in FIG. 7, the first jaw member 152 is here formed with an elongated slot 160 to extend in the direction of movement of the first jaw member 152. A pin 162 is removably positioned to extend through related structure and more particularly the housing 164. The pin 162 may have an aperture formed at one end so that it may be secured with a cotter key or pin (not shown) after it is installed.

The first jaw member 152 of FIG. 7 has an angular rear shoulder 166. The angulated shoulder 166 abuts a correlative surface 168 formed in the handle member 170. In operation, the spanner member 156 urges the first jaw member 152 in a downward direction 172. The elastically deformable rubber 174 is positioned underneath the first jaw member 152 to urge the first jaw member 152 in an upward direction 176 as illustrated. The slot 160 is shown enlarged in order to illustrate that full movement of the jaw member 152 in an upward 176 and downward 172 direction is available. That is, the pin 162 does not restrict the travel or motion of the first jaw member 152.

Figure 8:
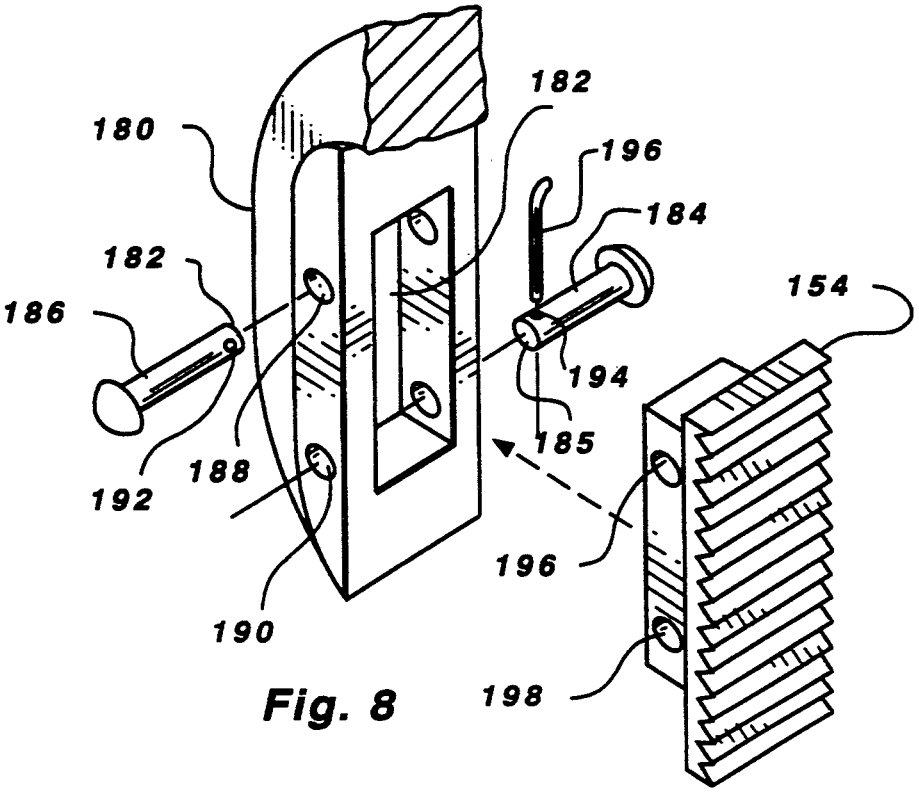
FIG. 8 is a partial perspective view of the head portion of the wrench of FIG. 2.

The extension 178 of the wrench 150 of FIG. 7 is similar in configuration to the extension 38 of FIG. 1. The second jaw member 154 is configured to be removable from the extension 178 as illustrated. As best illustrated in FIG. 8, the head portion 180 of extension 178 has a hollowed recess 182 which is sized to receive a corresponding insert 184 of the second jaw member 154. The insert 184 has a workpiece engaging surface 185 having a plurality of transverse searations 186 formed along the surface to interconnect with a workpiece such as workpiece 14 or any other similar member. The insert 184 is held in place in the head 180 by two pins. More specifically, pin 184 and pin 186 are sized to be positioned through a first aperture 188 and an axially aligned second aperture 190 which is formed to extend transversely through the head 180. The pins 184 and 186 have apertures 192 and 194 formed in their respective distal ends 185 and 187. The pins 184 and 186 are sized to extend through the apertures 190 and extend out the opposite side of the head 180 so that a cotter pin 196 may be inserted through the respective aperture such as aperture 192 or aperture 194. Obviously, the pins 184 and 186 are also sized to fit through corresponding apertures 196 and 198 formed in the insert 184.

Figure 9:
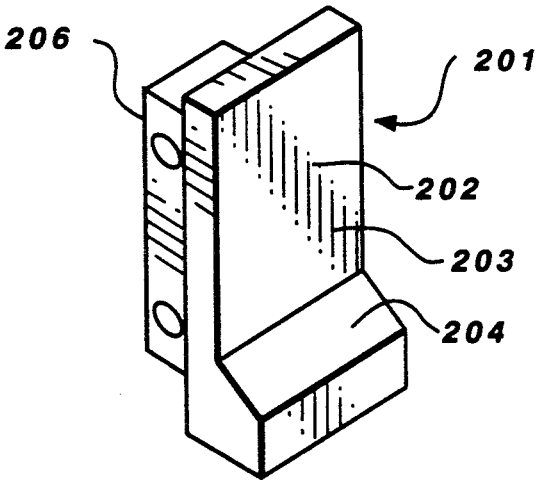
FIGS. 9 and 10 are an alternate workpiece engaging surface for use with the wrench of the invention.
Figure 10:
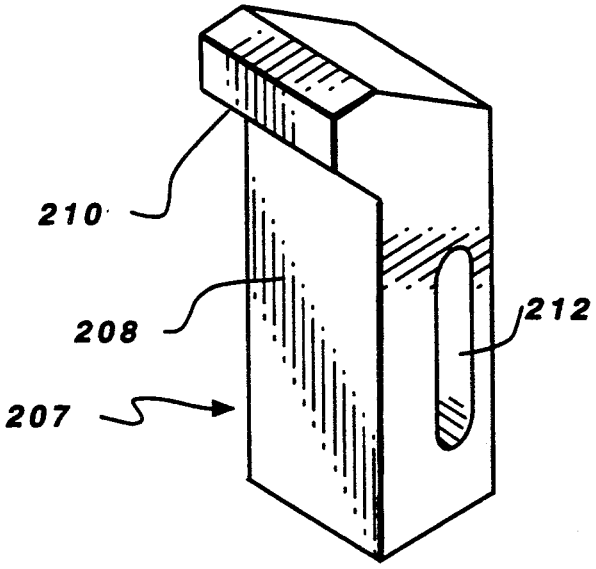

Upon removal of the pins 186 and 184, the insert 184 and in turn the second jaw member 154 may be removed and replaced with another structure such as the jaw member illustrated in FIG. 9. More specifically, a jaw member 201 is shown having a workpiece engaging surface 202 having a flat portion 203 and an angulated surface 204. The jaw member 201 illustrated in FIG. 9 also has an insert 206 which may be inserted into the aperture 182 of the head 180 to be secured there in place by pins 186 and 184. It may be noted that the surface 204 plus the surface 202 together with the underside or inside 206 of the extension 178 provide a surface for easy contact with a nut or bolt. Similarly, the first jaw member 152 may be replaced with the jaw member 207 shown in FIG. 10 having a planar surface 208 with an angulated surface 210. An elongated slot 212 is formed to receive the pin 162 to retain the jaw member 207 in place.

With the jaw members 201 and 207 in place in the wrench 150 of FIG. 7, it can be seen that the wrench 150 will be particularly suitable for a nut or bolt or similarly shaped workpiece. The same wrench 150 may be used for both a bolt as well as for a pipe by simply interchanging the first and second jaw members. Alternately configured jaw members may be used to perform other functions or to interface with other specifically shaped workpieces.

Figure 11:
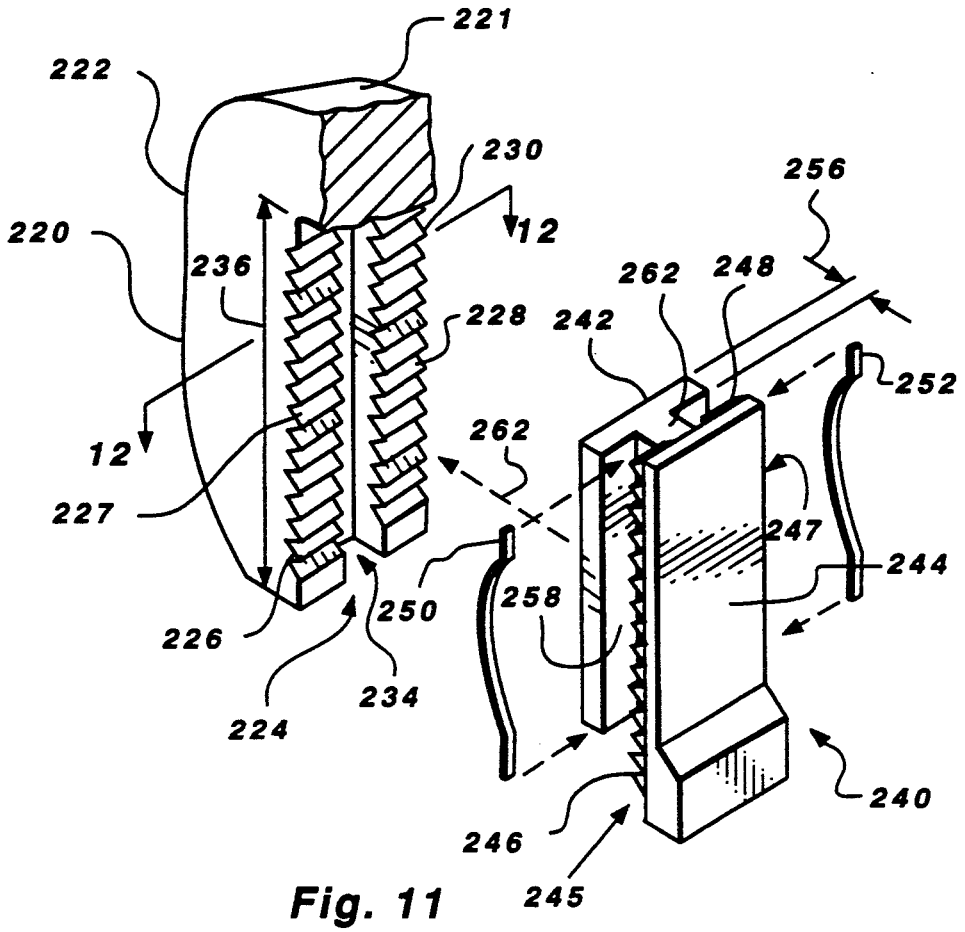
FIG. 11 is a partial perspective view of an alternate embodiment of the wrench of the instant invention.
Figure 12:
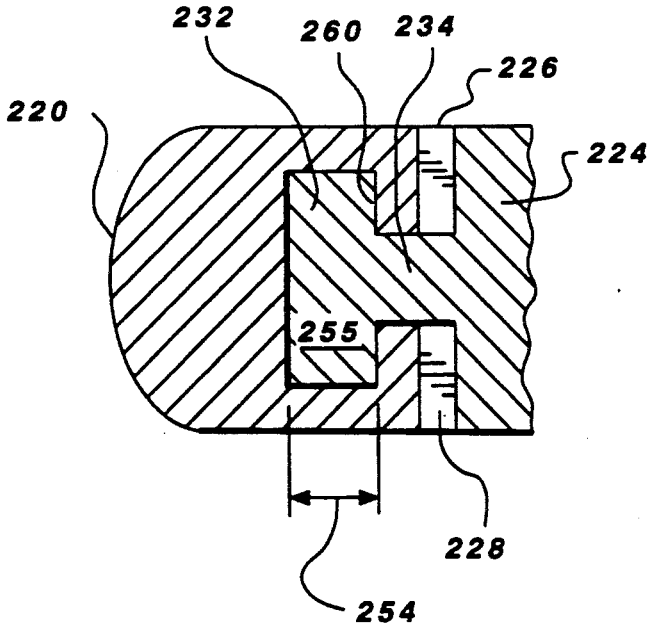
FIG. 12 is a sectional view of the wrench of FIG. 11 at section lines 12—12.

Referring to FIG. 11, only the head portion 220 of an extension 221 such as extension 38 or extension 178 is shown in partial perspective. FIG. 12 is a cross-section of the head 220 taken at section lines 12—12. The head 220 has a front face 222 and a rear face 224 which has a left section 226 and a right section 228. The left section 226 and right section 228 are formed with a plurality of searations 227 and 230, respectively.

A T-slot 232 is also formed in the head 220. The T-slot 232 has a throat 234 and extends in length 236 through the head 220. A jaw member 240 is formed to have a T-member 242 attached to the workpiece engaging surface 244. The T-member 242 is sized and shaped to fit within the T-slot 232. A plurality of searations 246 are formed on the rear of the left side 245 of the workpiece engaging surface 244. Similarly, a plurality of searations 248 are formed on the right side 247 of the workpiece engaging surface 244. The searations 246 and 248 are sized to snugly fit with the similar searations 227 of the left surface 226 and the searations 230 of the right surface 228 of the rear surface 224.

A left bar spring 250 and a right bar spring 252 are formed to fit within the T-slot 232. The depth 254 of the cross portion 255 of T-slot 232 is larger than the thickness 256 of T-member 242. Upon insertion of the jaw member 240 into the T-slot 232, the inner surface 258 of the T-member 242 may be held against the inner surface 260 of the T-slot 232 to slide the jaw member 240 into position. Thereafter the jaw member 240 is moved inwardly 262 toward the head 220. The searations 246 and 248 thereupon interface with the corresponding searations 222 and 230 formed in the surfaces 226 and 228 to rigidly hold the jaw member 240 in place. The left bar spring 250 is then inserted between the inner surface 258 and the surface 260 on the left side of the throat extension 262. The right spring 252 is inserted between the inner surface 258 and the surface 260 to the right of the throat extension 262. The springs 250 and 252 urge the T-member 242 away from the surface 260 to snugly hold the searations 246 and 248 against similar searations 227 and 230 and in turn hold the jaw members in place. Other configurations may be used to hold the jaw member 240 in position on the head 220 including nuts and bolts, pins, snaps or the like.

Figure 13:
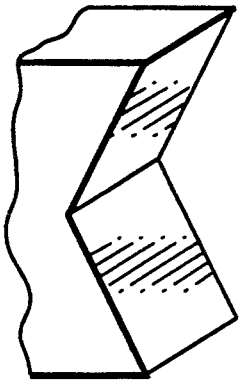
FIG. 13 is an alternate workpiece engaging surface.

As hereinbefore noted, other shapes or configurations of the workpiece engaging surface of the first and second jaw members may be provided to accommodate different configurations of a workpiece. FIG. 13 shows in partial cutaway an alternate configuration for the workpiece engaging surfaces of the first jaw member and the second jaw member of the wrench 150 of FIG. 1 as well as the wrench of FIG. 11.

The embodiments hereinbefore illustrated are not intended to limit the scope of the claims which themselves recite those features which are regarded as essential to the invention.

What is claimed:

1. A wrench comprising:

handle means for grasping by the user;

jaw means adapted to said handle means for gripping a workpiece, said jaw means including, a first jaw member movably secured to said handle means to move relative to said handle means about said workpiece, and a second jaw member positioned to move toward and away from said first jaw member to secure the workpiece thereinbetween;

connection means to connect said second jaw member to said handle means and for moving said second jaw member relative to said first member; and movement means adapted to said handle means and positioned to urge said first jaw member in a first direction about said workpiece, said movement means being operable to intermittently impact said first jaw member.

2. The wrench of claim 1 wherein said movement means includes return means connected to said handle means and positioned to contact said first jaw member to urge said first jaw member in a second direction opposite to said first direction.

3. The wrench of claim 2 wherein said movement means includes a striking member connected to an outside source of energy and positioned proximate said first jaw member to intermittently impact said first jaw member to urge said first jaw member in said first direction.

4. The wrench of claim 3 wherein said workpiece has an axis and wherein said first jaw member moves to urge said workpiece to rotate about the said axis of said workpiece.

5. The wrench of claim 4 wherein said striking member includes a hammer member positioned to urge said first jaw member to rotate about the said axis of said workpiece and a motor member to intermittently drive said hammer member.

6. The wrench of claim 5 wherein said first jaw member has a first workpiece engaging surface for contact with said workpiece and wherein said second jaw member has a second workpiece engaging surface for contact with said workpiece.

7. The wrench of claim 6 wherein said first workpiece engaging surface is essentially planar and formed to have friction means for frictionally engaging the said workpiece.

8. The wrench of claim 7 wherein said second workpiece engaging surface is essentially planar and formed to have friction means for frictionally engaging the said workpiece.

9. The wrench of claim 7 wherein said handle means has a handle axis and wherein said first jaw member is positioned to move substantially transversely to said handle axis.

10. The wrench of claim 9 wherein said hammer member is secured to said handle means to rotate about a hammer axis which is substantially transverse to said handle axis, said hammer member having a first surface positioned to be contacted by said motor member to urge said hammer member to rotate about said hammer axis to urge said first jaw member in said first direction.

11. The wrench of claim 10 wherein said motor means has an impact member extending therefrom to contact said first surface of said hammer member, said motor means being positioned relative to said handle means to extend in a direction in general alignment with the handle axis.

12. The wrench of claim 11 wherein said motor means is an air motor.

13. The wrench of claim 11 wherein said motor means is a solenoid.

14. The wrench of claim 9 wherein said striking member includes a motor positioned on said handle, said motor having a rotatable shaft extending therefrom and a cam secured to said rotatable shaft relative to said first jaw member to intermittently urge said first jaw member in said first direction upon rotation of said rotatable shaft.

15. The wrench of claim 4 wherein said handle means includes a grip portion for grasping by the user to rotate said handle mean about said axis of said workpiece.

16. The wrench of claim 10 wherein said connection means includes an adjustment having a jaw end to which said second jaw member is connected and a threaded end threadedly engaged in a rotatable member secured to said handle means operable to move said second jaw member toward and away from said first jaw member.

17. The wrench of claim 16 wherein said adjustment member has an axis in general alignment with said handle axis, and wherein said wrench further includes a spanner member positioned to contact said first jaw member to urge movement thereof and for contact by said hammer member, said spanner member being formed to move about said adjustment member.

18. The wrench of claim 6 wherein said first jaw member includes first jaw member connecting means for removably connecting said first workpiece engaging surface to said handle means.

19. The wrench of claim 18 wherein said first workpiece engaging surface is one of a plurality of separately shaped surfaces each selectable by the user for a desired workpiece.

20. The wrench of claim 16 wherein said second jaw member includes second jaw member connecting means for removably connecting said second workpiece engaging surface to said connection means.

21. The wrench of claim 18 wherein said second workpiece engaging surface is one of a plurality of separately shaped surfaces, each selectable by the user for a desired workpiece.

22. A pipe wrench for rotating a workpiece about an axis, said pipe wrench comprising:

a handle having a jaw end and a grip end;

a first jaw member movably attached to said jaw end to move relative to said handle, said first jaw member having a friction surface for engaging a workpiece;

an adjustment member attached to said handle to extend therefrom, said adjustment member having a jaw end and a threaded end threadedly secured to said handle and operable to move said jaw end toward and away from said handle;

a second jaw member secured to said jaw end of said adjustment member and positioned to move relative to said first jaw member to grasp said workpiece therebetween upon operation of said adjustment member;

a spanner member extending from said first jaw member and around said adjustment member;

a hammer having a first surface positioned to contact said spanner member and a second surface, said hammer being rotatably mounted to said handle to urge said spanner member to contact said first jaw member to urge said first jaw member in a first direction;

a motor secured to said handle, said motor having a shaft operable to intermittently impact said second surface of said hammer member;

a return spring positioned to urge said first jaw member in a second direction opposite to said first direction.

23. The pipe wrench of claim 22 further including means connected to said handle to activate and deactivate said motor.

24. The pipe wrench of claim 23 wherein said motor is an air motor.

* * * * *